US009926727B2

(12) United States Patent
Kouzuma et al.

(10) Patent No.: US 9,926,727 B2
(45) Date of Patent: Mar. 27, 2018

(54) LATCH RELEASE DEVICE FOR VEHICLE DOOR

(71) Applicant: KABUSHIKI KAISHA HONDA LOCK, Miyazaki-shi, Miyazaki (JP)

(72) Inventors: Hiroyuki Kouzuma, Miyazaki (JP); Hiroto Fujiwara, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 657 days.

(21) Appl. No.: 14/413,283

(22) PCT Filed: May 30, 2013

(86) PCT No.: PCT/JP2013/065072
§ 371 (c)(1),
(2) Date: Jan. 7, 2015

(87) PCT Pub. No.: WO2014/010326
PCT Pub. Date: Jan. 16, 2014

(65) Prior Publication Data

US 2015/0191944 A1 Jul. 9, 2015

(30) Foreign Application Priority Data

Jul. 9, 2012 (JP) ..... 2012-153680

(51) Int. Cl.
*E05B 3/00* (2006.01)
*E05B 85/12* (2014.01)
(Continued)

(52) U.S. Cl.
CPC ..... *E05B 85/12* (2013.01); *E05B 77/26* (2013.01); *E05B 81/16* (2013.01); *E05B 81/34* (2013.01);
(Continued)

(58) Field of Classification Search
CPC ..... E05B 77/26; E05B 81/06; E05B 77/24; Y10T 292/1082; Y10S 292/23; E05F 15/76
See application file for complete search history.

(56) References Cited

U.S. PATENT DOCUMENTS 6,305,736 B1 10/2001 Enomoto et al.
8,182,004 B2 5/2012 Yoda
(Continued)

FOREIGN PATENT DOCUMENTS

CN 101463684 A 6/2009
CN 101736961 A 6/2010
(Continued)

OTHER PUBLICATIONS

Official Communication dated May 10, 2016 corresponding to European Application No. 13 81 7483.
(Continued)

*Primary Examiner* — Mark A Williams
(74) *Attorney, Agent, or Firm* — Carrier Blackman & Associates, P.C.; Joseph P. Carrier; Jingli Wang

(57) ABSTRACT

A latch release device for a vehicle door is provided which includes an electric actuator that can exert power for latch release for releasing a latched state of a door, a latch mechanism that releases the latched state of the door in response to actuation of the electric actuator or input of a mechanical latch release operating force, and an operating member for latch release that enables normal operation by a vehicle user so as to actuate the electric actuator and emergency operation by a vehicle user so as to input a mechanical latch release operating force into the latch mechanism, wherein the emergency operation of an operating member for latch release is restricted and emergency operation restriction means restricts emergency operation of the operating member for latch release when an operating
(Continued)

member for restriction release that a vehicle user can operate is in a non-operated state.

5 Claims, 17 Drawing Sheets

(51) Int. Cl.

| | |
|---|---|
| ***E05B 77/26*** | (2014.01) |
| ***E05B 81/16*** | (2014.01) |
| ***E05B 81/90*** | (2014.01) |
| ***E05B 81/34*** | (2014.01) |
| *E05B 79/20* | (2014.01) |
| *E05B 79/22* | (2014.01) |
| *E05B 81/06* | (2014.01) |
| *E05B 81/76* | (2014.01) |

(52) U.S. Cl.
CPC ..... *E05B 81/90* (2013.01); *E05B 79/20* (2013.01); *E05B 79/22* (2013.01); *E05B 81/06* (2013.01); *E05B 81/76* (2013.01); *Y10T 292/57* (2015.04)

(56) References Cited

U.S. PATENT DOCUMENTS

| | | | | |
|---|---|---|---|---|
| 8,282,142 | B2 | 10/2012 | Fannon | |
| 8,528,949 | B2 | 9/2013 | Katsumata et al. | |
| 2007/0210588 | A1* | 9/2007 | Cetnar | E05L 377/26 292/216 |
| 2010/0235059 | A1 | 9/2010 | Krishnan et al. | |
| 2010/0244466 | A1* | 9/2010 | Tomaszewski | E05B 77/26 292/201 |
| 2010/0327609 | A1* | 12/2010 | Akizuki | E05B 81/06 292/85 |
| 2012/0139269 | A1* | 6/2012 | Kouzuma | E05L 381/14 292/195 |
| 2012/0323384 | A1* | 12/2012 | Park | H04L 12/2803 700/286 |
| 2015/0259952 | A1* | 9/2015 | Barmscheidt | E05B 77/265 292/200 |
| 2016/0362916 | A1* | 12/2016 | Tomaszewski | E05B 79/16 |

FOREIGN PATENT DOCUMENTS

| | | | |
|---|---|---|---|
| DE | 10059694 | A1 | 6/2001 |
| EP | 1 666 685 | B1 | 8/2008 |
| JP | S64-18268 | U | 1/1989 |
| JP | H06-35091 | Y2 | 9/1994 |
| JP | 2006-151315 | A | 6/2006 |
| JP | 2007270586 | A | 10/2007 |
| JP | 2011-094436 | A | 5/2011 |
| WO | 2010122887 | A1 | 10/2010 |

OTHER PUBLICATIONS

Official Communication dated Feb. 2, 2016 corresponding to Chinese Patent Application No. 201380036529.2.

* cited by examiner

LATCH RELEASE DEVICE FOR VEHICLE DOOR

TECHNICAL FIELD

The present invention relates to a latch release device for a vehicle door that includes an electric actuator that can exert power for latch release for releasing a latched state of a door, a latch mechanism that releases the latched state of the door in response to actuation of the electric actuator or input of a mechanical latch release operating force, and an operating member for latch release that enables normal operation by a vehicle user so as to actuate the electric actuator and emergency operation by a vehicle user so as to input a mechanical latch release operating force into the latch mechanism.

BACKGROUND ART

An arrangement in which when the situation is normal a latched state of a door is released by pushing with a small amount of travel an open button provided on the door so as to actuate an electric actuator, and when the latched state of the door cannot be released electrically due to a malfunction caused by a flat battery, etc., an emergency operation is carried out by pushing the open button further than that for normal operation to thus input a mechanical latch release operating force to a latch mechanism via an arm and cable linked to the open button to thereby enable the latched state of the door to be released is known from Patent Document 1.

RELATED ART DOCUMENTS

Patent Documents

Patent Document 1: Japanese Utility Model Registration Publication No. 6-35091

SUMMARY OF THE INVENTION

Problems to be Solved by the Invention

However, in the arrangement disclosed in Patent Document 1 above, the same open button is pushed both at a time of normal operation and at a time of emergency operation; since there is no means for restricting an emergency operation there is a possibility that an emergency operation will be carried out when the situation is normal, and there is the problem that an unnecessary emergency operation will be carried out.

The present invention has been accomplished in light of such circumstances, and it is an object thereof to provide a latch release device for a vehicle door in which an emergency operation of a latch release operating member is prevented from being carried out unnecessarily.

Means for Solving the Problems

In order to attain the above object, according to an aspect of the present invention, there is provide a latch release device for a vehicle door including a latch mechanism that is selectively movable between latched and unlatched states thereof, the latch release device, the latch release device comprising an electric actuator which is operatively connected to the latch mechanism and exerts power for moving the latch mechanism to the unlatched state thereof, a first manually operable operating member that is operatively connected to the latch mechanism and the electric actuator, the first manually operable operating member being configured to activate the electric actuator for moving the latching mechanism to the unlatched state thereof and also configured to assume an emergency unlatching position thereof that applies a mechanical operating force to the latch mechanism for moving the latching mechanism to the unlatched state thereof, a second manually operable operating member operatively associated with the first manually operable operating member, and an emergency operation restrictor that restricts the first manually operable operating member from assuming the emergency unlatching position thereof when the second manually operable operating member is in a non-operated position thereof, but allows the first manually operable operating member to be moved to the emergency unlatching position thereof when the second manually operable operating member is in an operated position thereof.

An electric motor for latch release 24 of an embodiment corresponds to the electric actuator of the present invention, a push button 29 of the embodiment corresponds to the operating member for latch release (also referred as a first manually operable operating member) of the present invention, and a driver's seat-side side door DA and a rear side door DB of the embodiment correspond to the door of the present invention. Operating member for restriction release 37 of the embodiment corresponds to a second manually operable operating member. Emergency operation restriction means 38 of the embodiment corresponds to an emergency operation restrictor.

Effects of the Invention

In accordance with the arrangement of the present invention, since in a state in which the operating member for restriction release is not operated, emergency operation of the operating member for latch release is restricted by the emergency operation restriction means, and an emergency operation of the operating member for latch release is allowed by operating the operating member for restriction release, it is possible to avoid an unnecessary emergency operation of the operating member for latch release.

EXPLANATION OF REFERENCE NUMERALS AND SYMBOLS

22A, 22B Latch mechanism

24 Electric motor for latch release, which is an electric actuator

29 Push button, which is an operating member for latch release (also referred as a first manually operable operating member as stated above)

37 Operating member for restriction release (also referred as a second manually operable operating member as stated above)

38 Emergency operation restriction means (also referred as an emergency operation restrictor as stated above)

DA Driver's seat-side side door, which is a door

DB Rear side door, which is a door

MODE FOR CARRYING OUT THE INVENTION

A mode for carrying out the present invention is explained below by reference to the attached FIG. 1 to FIG. 19.

First Embodiment

Figure 1:
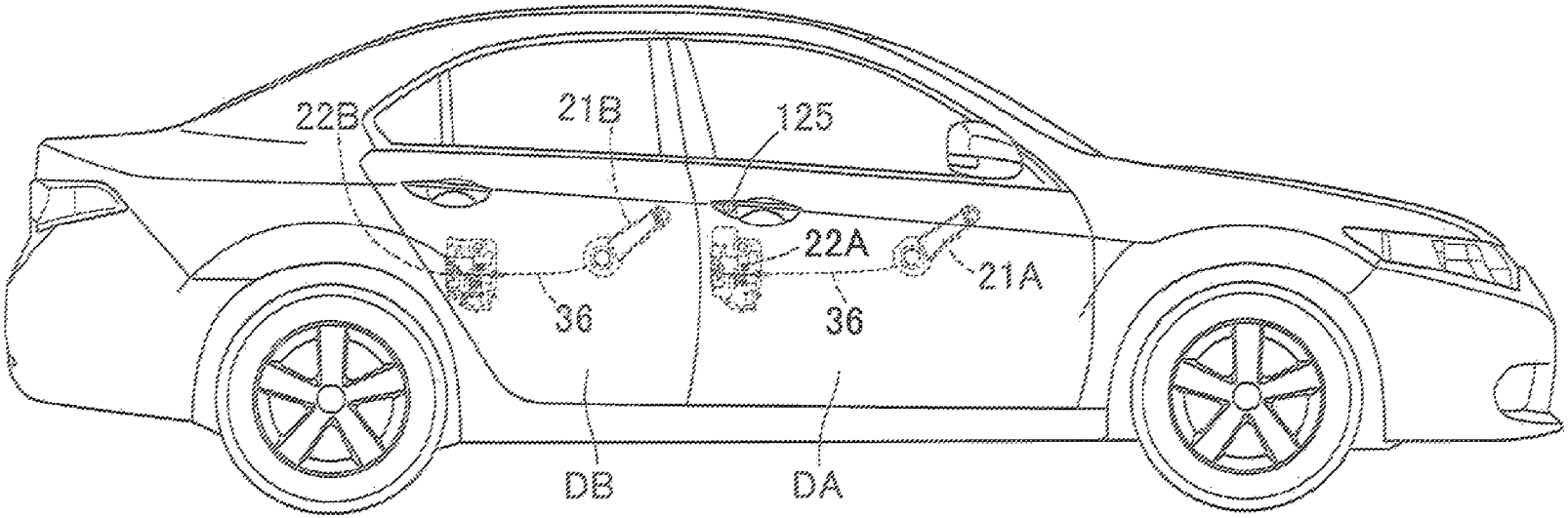
FIG. 1 is a side view of a passenger vehicle (first embodiment).

First, in FIG. 1, a driver's seat-side side door DA of a passenger vehicle is provided with an inside handle 21A for a vehicle user on the driver's seat to carry out an open/close operation of the driver's seat-side side door DA on the vehicle compartment side, and also has disposed thereon a latch mechanism 22A that can switch between a latched state in which a closed state of the driver's seat-side side door DA is retained by engagement with the vehicle body side and an unlatched state in which the driver's seat-side side door DA can be opened. Furthermore, a rear side door DB of the passenger vehicle is provided with an inside handle 21B for a vehicle user on a rear seat to carry out an open/close operation of the rear side door DB on the vehicle compartment side, and also has disposed thereon a latch mechanism 22B that can switch between a latched state in which a closed state of the rear side door DB is retained by engagement with the vehicle body side and an unlatched state in which the rear side door DB can be opened.

Figure 2:
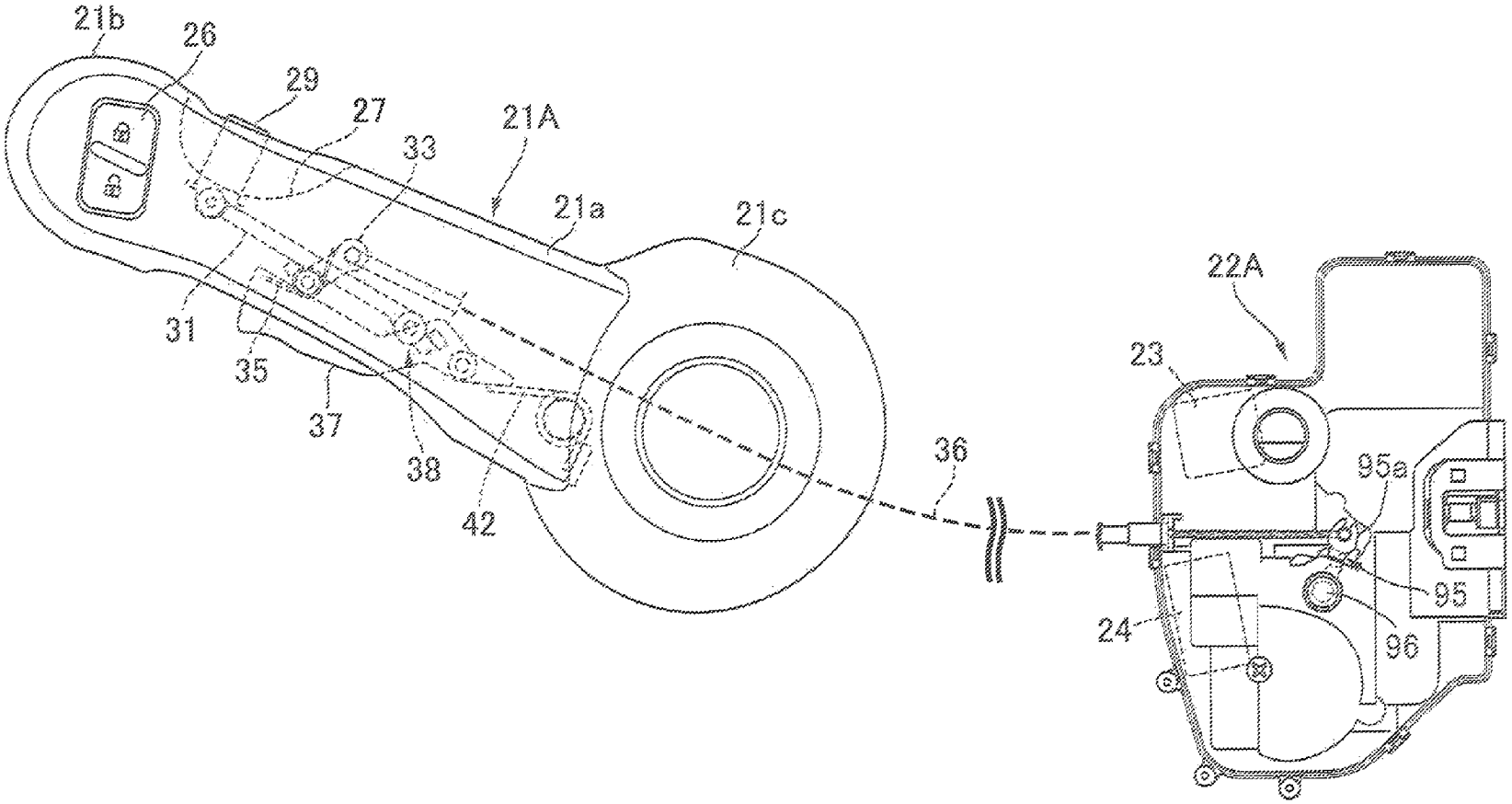
FIG. 2 is a side view of an inside handle and a latch mechanism of a driver's seat-side side door when viewed from the vehicle compartment side (first embodiment).

In FIG. 2, the latch mechanism 22A of the driver's seat-side side door DA includes a reversible electric motor for lock/unlock switching 23 that exerts power for switching between an unlocked state in which latch release of the driver's seat-side side door DA is enabled and a locked state in which latch release of the driver's seat-side side door DA is disabled, and an electric motor for latch release 24, which is an electric actuator that exerts power for releasing the latched state in the unlocked state. Furthermore, the latch mechanism 22A can carry out latch release according to mechanical input of a latch release operating force due to operation by a vehicle user within the vehicle compartment either in the locked state or the unlocked state.

Figure 3:
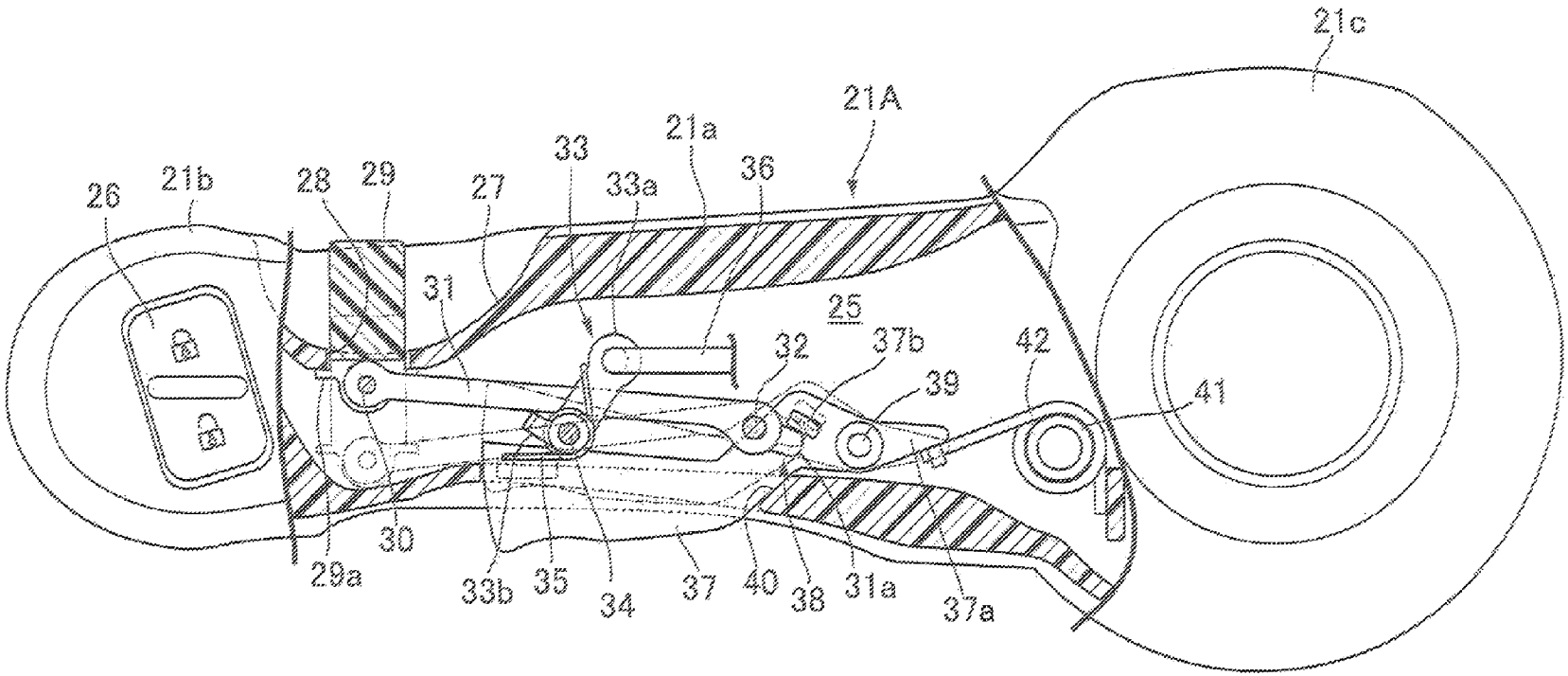
FIG. 3 is a partially cutaway enlarged side view of the inside handle (first embodiment).

Referring in addition to FIG. 3, the inside handle 21A is formed so as to have a hollow part 25 in its interior, and is formed from a grip portion 21*a* that extends lengthwise in the fore-and-aft direction of the vehicle, a circular front support portion 21*b* that is connectedly provided at the front end of the grip portion 21*a*, and a rear support portion 21*c* that is formed as a larger circle than that of the front support portion 21*b* and is connectedly provided at the rear end of the grip portion 21*a*, the front support portion 21*b* and the rear support portion 21*c* of the inside handle 21A, which is inclined upwardly to the front, being fixed to an inner face side of the driver's seat-side side door DA.

Disposed on a face of the front support portion 21*b* of the inside handle 21A facing the interior of the vehicle compartment is a switch for lock/unlock switching 26 for switching between the locked state and the unlocked state of the latch mechanisms 22A, 22B of all doors including the driver's seat-side side door DA and the rear side door DB of the passenger vehicle.

Formed on a front upper face of the grip portion 21*a* of the inside handle 21A is a downwardly-recessed recess 27; provided therein is a button insertion hole 28 opening in a substantially central part of the recess 27, and disposed in the button insertion hole 28 is a push button 29, which is an operating member for latch release. This push button 29 is inserted into the button insertion hole 28 while an upper end part of the push button 29 faces the recess 27, a collar portion 29*a* protruding radially outwardly is provided integrally with a lower part of the push button 29, and the collar portion 29*a* can abut against and engage with an inner face of the peripheral edge of the button insertion hole 28 from below.

A front end part of a link lever 31 extending in the fore-and-aft direction of the vehicle and disposed within the hollow part 25 is linked to a lower end part of the push button 29 via a pin 30. On the other hand, a rear end part of the link lever 31 is pivotably supported on a lower part, on one side close to the rear support portion 21*c*, of the grip portion 21*a* of the inside handle 21A via a first support shaft 32, and the link lever 31 pivots around the axis of the first support shaft 32 in response to a pushing operation of the push button 29.

A lever 33 is pivotably supported, via a second support shaft 34, on a portion, corresponding to a longitudinally intermediate part of the link lever 31, of the lower part of the grip portion 21*a* on one side. This lever 33 has a substantially L-shaped form while integrally having a link arm portion 33*a* that has one end part supported on the grip portion 21*a* via the second support shaft 34 and an abutment arm portion 33*b* that is provided so as to be connected at substantially right angles to one end part of the link arm portion 33*a* and abuts against the lower end of the longitudinally intermediate part of the link lever 31. A torsion spring 35 is provided between the grip portion 21*a* and the lever 33, and the lever 33 is pivotingly urged toward the side on which the abutment arm portion 33*b* abuts against the link lever 31 from below by virtue of a spring force exhibited by the torsion spring 35. Furthermore, one end part of a cable 36 for transmitting a mechanical latch release operating force to the latch mechanism 22A is linked to the other end part of the link arm portion 33*a*.

The spring force of the torsion spring 35 acts on the push button 29 from the lever 33 via the link lever 31, and in a non-operated state the push button 29 is present at a non-operated position in which, as shown by the solid line in FIG. 3, the collar portion 29*a* abuts against the inner face of the peripheral edge of the button insertion hole 28.

Figure 4:
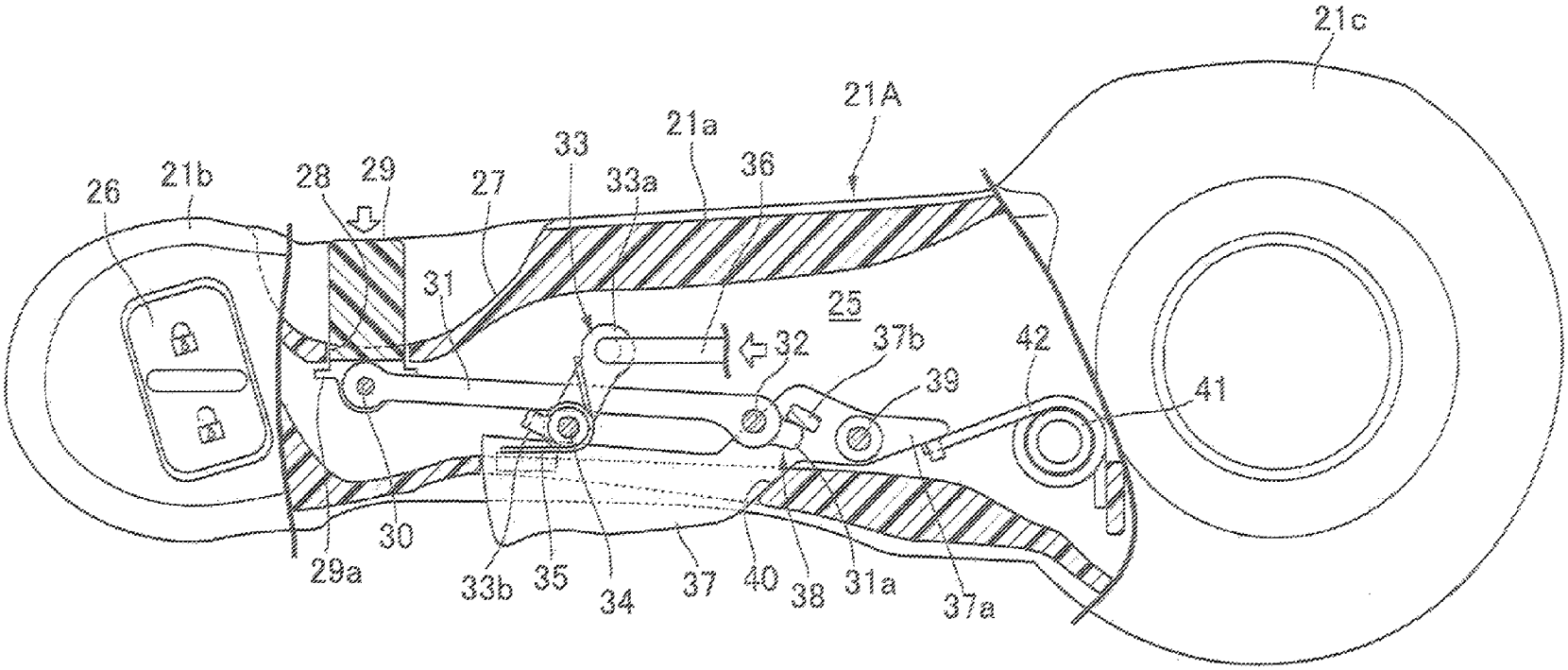
FIG. 4 is a view, corresponding to FIG. 3, in a normal operation state (first embodiment).
Figure 5:
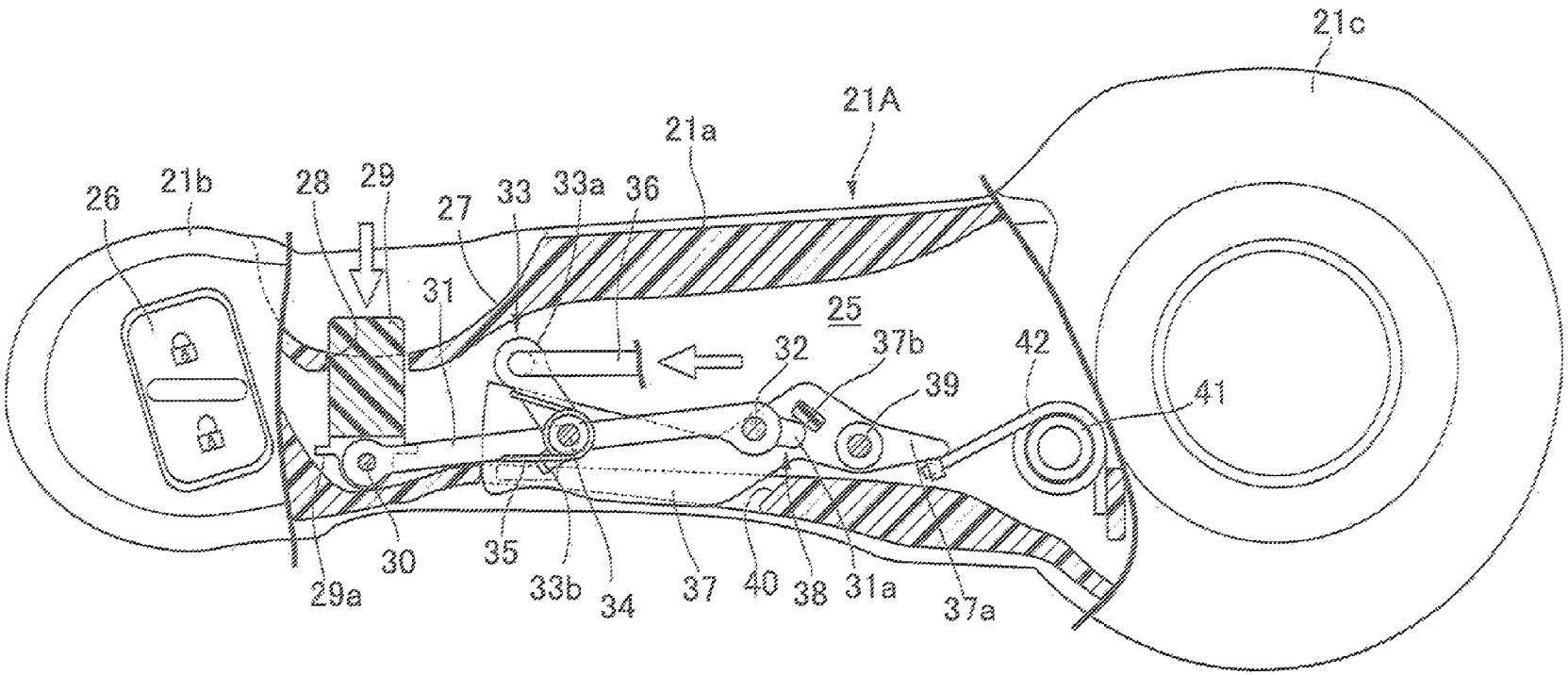
FIG. 5 is a view, corresponding to FIG. 3, in an emergency operation state (first embodiment).

A vehicle user can carry out a normal operation in which the push button 29 is pushed only by a small amount of travel from the non-operated position to the normal operation position shown in FIG. 4 so as to actuate the electric motor for latch release 24 of the latch mechanism 22A, and an emergency operation in which the push button 29 is pushed by large amount of travel from the non-operated position to the emergency operation position shown in FIG. 5 in order to input a mechanical latch release operating force into the latch mechanism 22A. When the push button 29 is subjected to the normal operation, the link lever 31 slightly pivots, the lever 33 is thereby slightly pivoted, and the cable 36 is slightly pulled. When the push button 29 is subjected to the emergency operation, the link lever 31 pivots a large amount, the lever 33 is thereby pivoted a large amount, and the cable 36 is pulled a large amount.

The emergency operation of the push button 29 is restricted by emergency operation restriction means 38 when an operating member for restriction release 37 is in a non-operated state, and the emergency operation restriction means 38 allows an emergency operation of the push button 29 in response to operation of the operating member for restriction release 37 by a vehicle user.

The operating member for restriction release 37 is formed so as to extend lengthwise in the fore-and-aft direction of the vehicle, a rear part thereof being pivotably linked to the lower part of the grip portion 21*a* of the inside handle 21A to the rear of the first support shaft 32 via a third support shaft 39. Furthermore, an opening 40 is provided in the lower part of the grip portion 21*a* so as to be long in the fore-and-aft direction; part of a front part of the operating member for restriction release 37 in the non-operated state projects from the opening 40 beneath the grip portion 21*a*, and a vehicle user can carry out an emergency operation of the push button 29 while pushing upwardly the front part of the operating member for restriction release 37 in a state in which the grip portion 21*a* of the inside handle 21A is gripped.

The operating member for restriction release 37 integrally has in a rear end part a spring receiving portion 37*a* projecting to the rear of the third support shaft 39, and a torsion spring 42 wound around a cylindrical spring support part 41 provided integrally with the rear support portion 21*c* of the inside handle 21A is provided between the rear support portion 21*c* and the spring receiving portion 37*a*. The operating member for restriction release 37 is spring-biased, by virtue of a spring force exhibited by the torsion spring 42, toward the side on which the front part of the operating member for restriction release 37 projects downwardly from the opening 40, and the end of pivoting of the operating member for restriction release 37 in the direction in which it is urged by the torsion spring 42 is restricted by the operating member for restriction release 37 abutting against the peripheral edge of the opening 40.

The emergency operation restriction means 38 is formed from a restriction projecting portion 37*b* that is provided in a rear part of the operating member for restriction release 37, and an abutment projecting portion 31*a* projectingly provided integrally with the rear end part of the link lever 31 to the rear of the first support shaft 32 so as to be able to abut against the restriction projecting portion 37*b* from below. When the push button 29 is at the non-operated position and the operating member for restriction release 37 is in the non-operated state, the abutment projecting portion 31*a* is present at a position slightly below the restriction projecting portion 37*b* as shown in FIG. 3, and when in this state the push button 29 is pushed, as shown in FIG. 4 the abutment projecting portion 31*a* abuts against the restriction projecting portion 37*b* to thus restrict pivoting of the link lever 31, and pushing of the push button 29 is restricted to a normal operation with a small amount of travel.

When the operating member for restriction release 37 is pushed, as shown by the chain line in FIG. 3, the operating member for restriction release 37 pivots in a direction in which the restriction projecting portion 37*b* moves away from the abutment projecting portion 31*a*, in this state the amount of pivoting of the link lever 31 that makes the abutment projecting portion 31*a* abut against the restriction projecting portion 37*b* becomes large, and as shown in FIG. 5 the push button 29 can be subjected to an emergency operation up to the emergency operation position with a large amount of travel.

Figure 6:
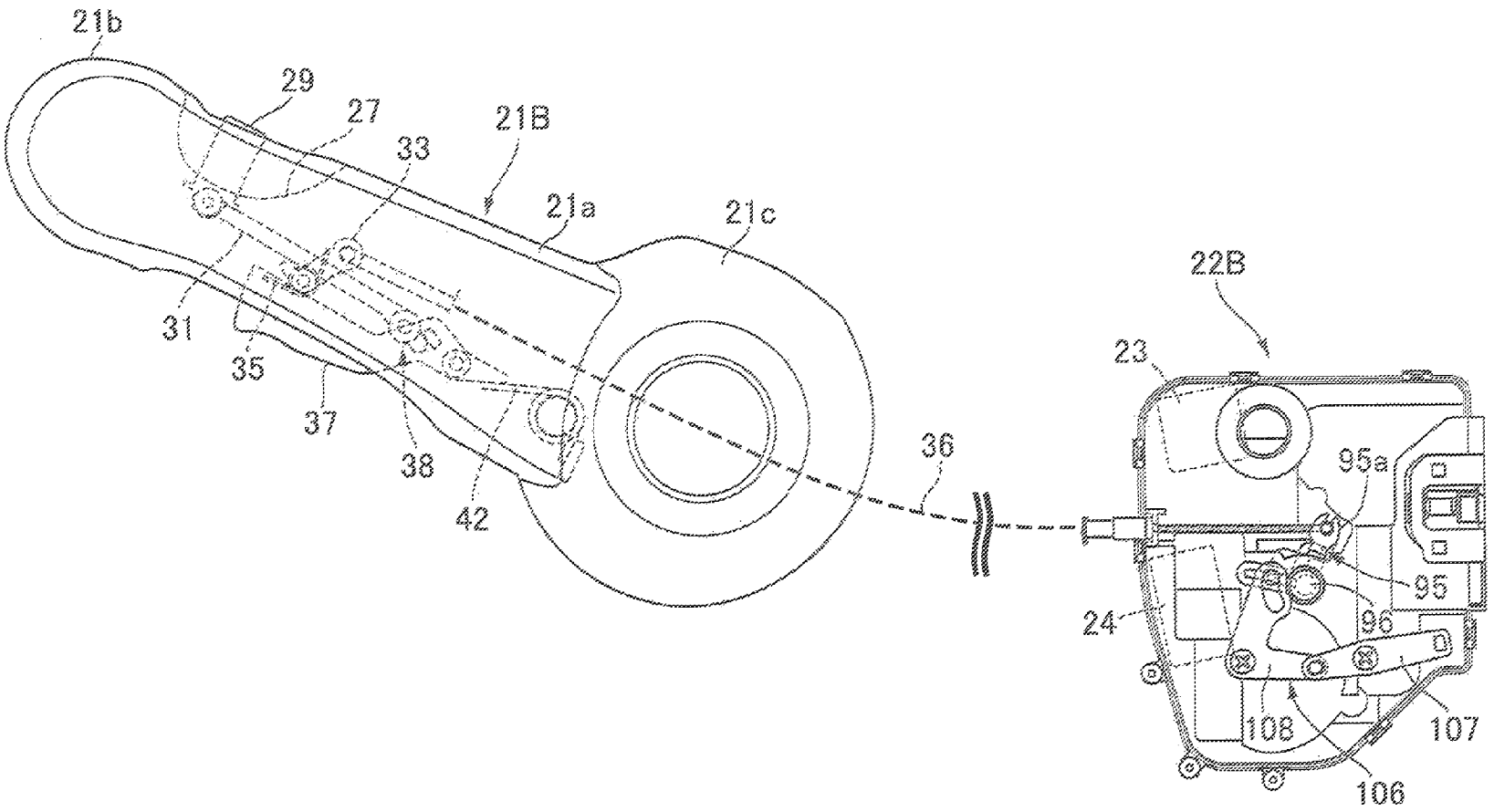
FIG. 6 is a side view of an inside handle and a latch mechanism of a rear side door when viewed from the vehicle compartment side (first embodiment).

In FIG. 6, the inside handle 21B of the rear side door DB has basically the same arrangement as that of the inside handle 21A of the driver's seat-side side door DA except that the switch for lock/unlock switching 26 provided on the inside handle 21A of the driver's seat-side side door DA is not provided, the push button 29, the link lever 31, the lever 33, the operating member for restriction release 37, the emergency operation restriction means 38, etc. being disposed in the same manner as for the inside handle 21A of the driver's seat-side side door DA. The cable 36 for transmitting a mechanical latch release operating force to the latch mechanism 22B is slightly pulled when pushing of the push button 29 is restricted to a normal operation with a small amount of travel, and when the push button 29 is subjected to an emergency operation up to the emergency operation position with a large amount of travel while pushing the operating member for restriction release 37 the cable 36 is pulled a large amount.

The latch mechanism 22B of the rear side door DB includes the reversible electric motor for lock/unlock switching 23 that exerts power for switching between an unlocked state in which latch release of the rear side door DB is enabled and a locked state in which latch release of the rear side door DB is disabled, and the electric motor for latch release 24, which is an electric actuator that exerts power for releasing the latched state in the unlocked state. Furthermore, the latch mechanism 22B can carry out latch release in response to mechanical input of a latch release operating force due to operation by a vehicle user within the vehicle compartment either in the locked state or the unlocked state.

Figure 7:
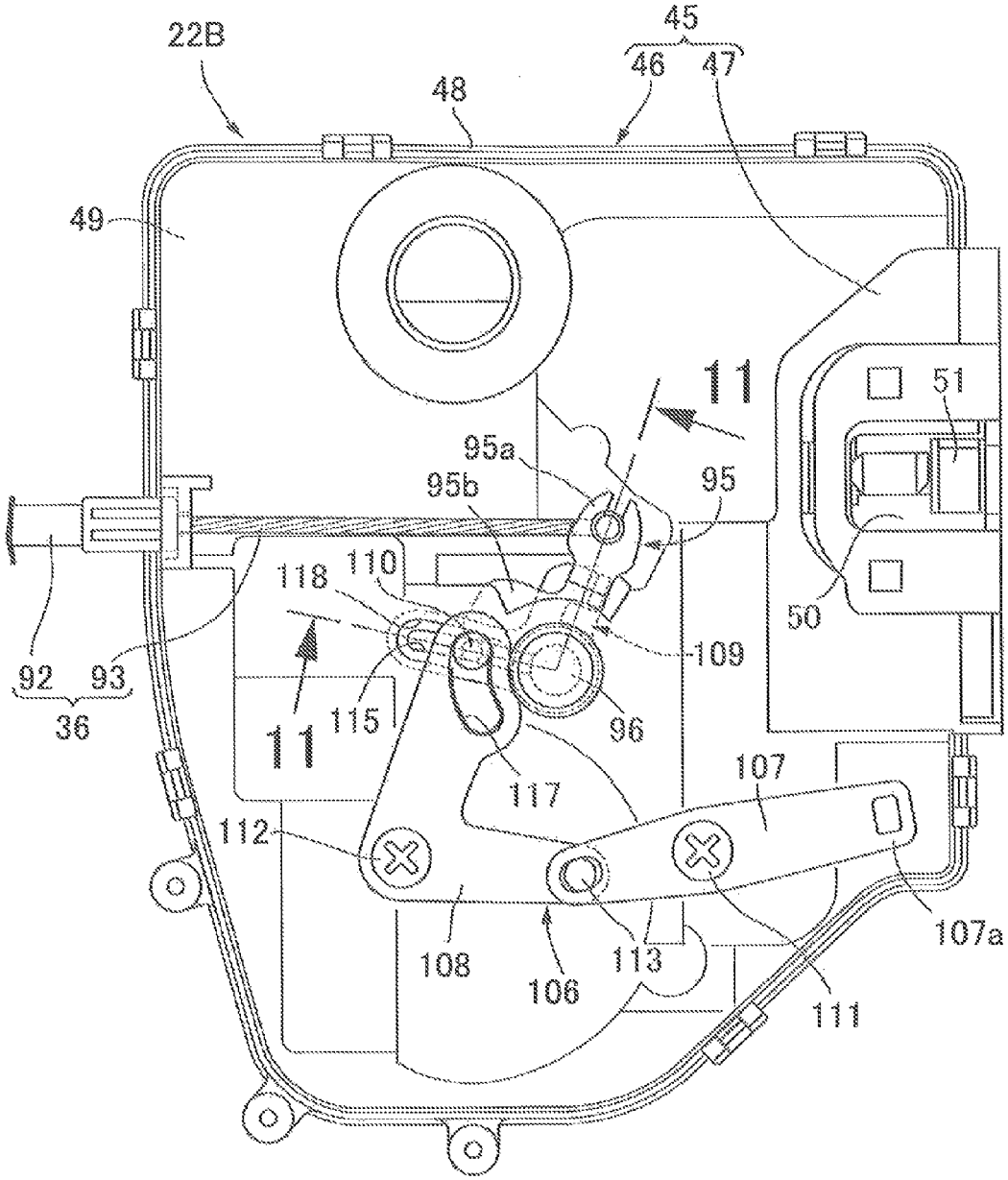
FIG. 7 is an enlarged side view of the latch mechanism (first embodiment).

In FIG. 7, a casing 45 of the latch mechanism 22B has a first case 46 housing the electric motor for lock/unlock switching 23 and the electric motor for latch release 24, and a second case 47 detachably mounted on the first case 46 while having an entry recess 50 for a striker (not illustrated) on the vehicle body side to enter. The first case 46 is formed from a box-shaped case main body 48 opening toward the vehicle compartment side, and a cover member 49 detachably mounted on the case main body 48 so as to close the open end of the case main body 48.

A latch 51 is pivotably supported on the second case 47, the latch 51 engaging with the striker entering the entry recess 50 when the rear side door DB is closed. A latched state in which the rear side door DB is retained in a closed state is attained by preventing pivoting of the latch 51, and the latched state of the rear side door DB is released by allowing pivoting of the latch 51.

Figure 8:
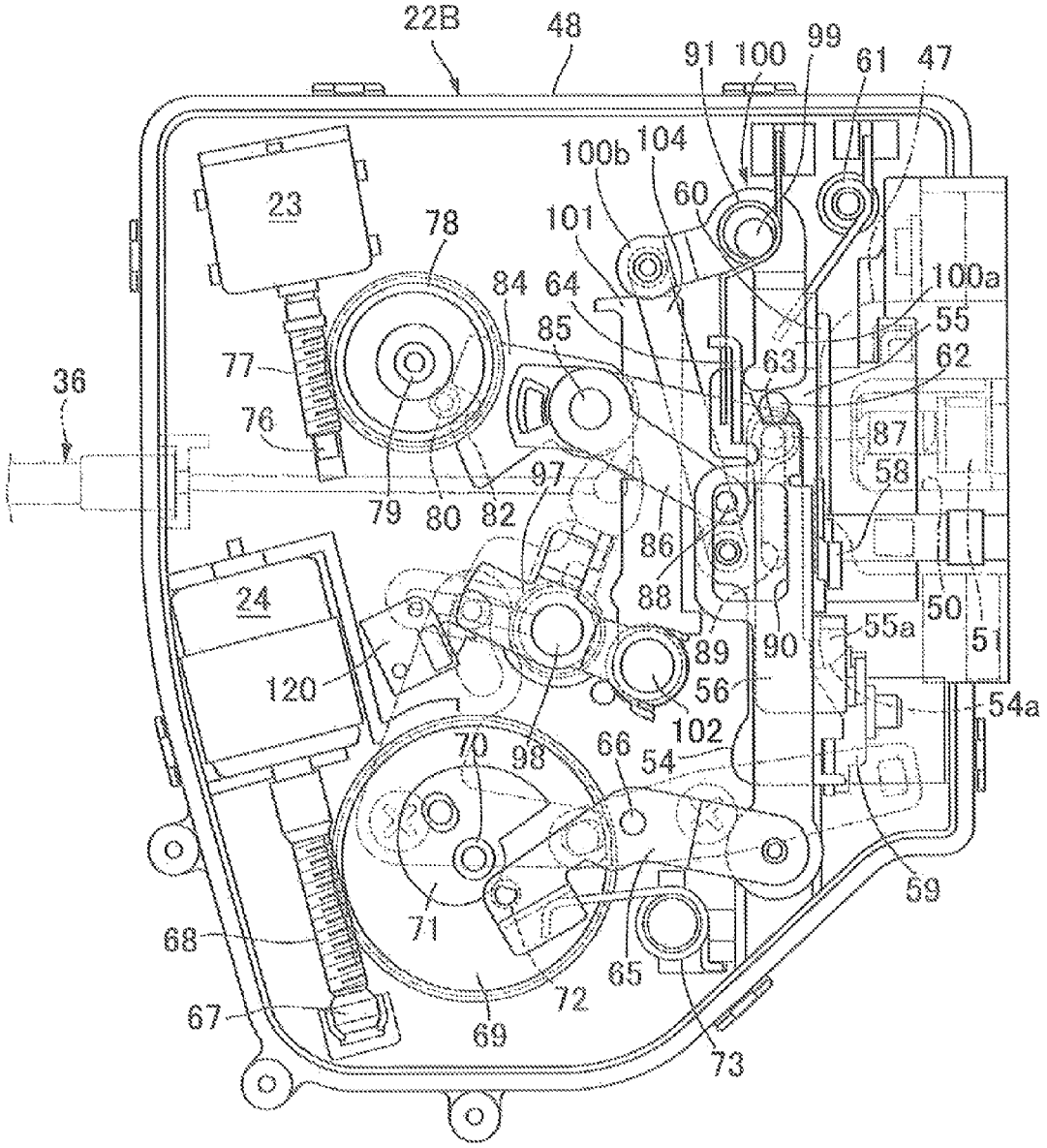
FIG. 8 is a side view of an essential part showing the latch mechanism in an unlocked state in a state in which a cover member and a second case are detached from a casing (first embodiment).

In FIG. 8, an open link 54, a release link 55, and a first cancel lever 56 are superimposed and disposed in a section, close to the second case 47, within the case main body 48 of the first case 46 in sequence from the side opposite to the cover member 49, the open link 54 or the release link 55 moves upwardly staying in a vertically extending attitude and abuts against and engages with a ratchet lever 58 from below to thus pivot the ratchet lever 58, pivoting of the latch 51 is thereby allowed, and the latched state of the rear side door DB is released.

An open lever 59 is pivotably supported on a lower part, on the second case 47 side, of the case main body 48, the open lever 59 pivoting in response to operation of an outside handle (not illustrated) disposed on the outer side of the rear side door DB, a lower end part of the open link 54 is linked to the open lever 59 so as to allow pivoting of the open link 54, and the open link 54 operates vertically in response to pivoting of the open lever 59. Moreover, a pressing portion 54*a* is provided on the open link 54, the pressing portion 54*a* being capable of abutting against and engaging with the ratchet lever 58 from below when the open link 54 is in a vertically extending attitude as shown in FIG. 8.

Furthermore, the release link 55 is supported on the case main body 48 so that it can be operated vertically, a guide wall 60 guiding vertical movement of the release link 55 is provided on the case main body 48 so as to be disposed between the release link 55 and the second case 47, and a torsion spring 61 urging the release link 55 toward the side on which it is in sliding contact with the guide wall 60 is provided between the case main body 48 and the release link 55. Furthermore, a link pin 62 is implanted in an upper part of the release link 55, and a pressing portion 55*a* that can abut against and engage with the ratchet lever 58 from below is provided on the release link 55.

An abutment face 63 is formed on an upper end part of the first cancel lever 56, the abutment face 63 being capable of abutting against the link pin 62 from below and from the side opposite to the guide wall 60, and a latching plate part 64 is provided on the upper end part of the first cancel lever 56, the latching plate part 64 opposing the link pin 62 from the side opposite to the second case 47.

A lower end part of the first cancel lever 56 is pivotably linked to one end part of a release lever 65, and an intermediate part of the release lever 65 is pivotably supported, via a fourth support shaft 66, on the case main body 48 so as to operate the first cancel lever 56 vertically.

The electric motor for latch release 24 is fixedly disposed on the case main body 48, and a worm wheel 69 meshing with a worm gear 68 provided on an output shaft 67 of the electric motor for latch release 24 is pivotably supported on the case main body 48 via a fifth support shaft 70 having an axis parallel to the fourth support shaft 66. A cam 71 pivoting with the worm wheel 69 is provided on this worm wheel 69, and a pin 72 that is in sliding contact with the cam 71 is implanted in the other end part of the release lever 65. Furthermore, a torsion spring 73 is provided between the case main body 48 and the release lever 65, the torsion spring 73 pivotingly urging the release lever 65 in a direction in which the pin 72 is put into sliding contact with the cam 71.

When the electric motor for latch release 24 is actuated so as to pivot the worm wheel 69 and the cam 71 in a counterclockwise direction in FIG. 8, due to the pin 72 being in sliding contact with the cam 71 the release lever 65 pivots in a counterclockwise direction in FIG. 8 and the first cancel lever 56 is pushed upwardly.

The electric motor for lock/unlock switching 23 is fixedly provided on an upper part of the case main body 48 above the electric motor for latch release 24, and a worm wheel 78 meshing with a worm gear 77 provided on an output shaft 76 of the electric motor for lock/unlock switching 23 is pivotably supported on the case main body 48 via a sixth support shaft 79 parallel to the fifth support shaft 70. An engagement projection 80 is provided on the worm wheel 78 so as to be offset from the central axis thereof, a fan-shaped first locking lever 84 is pivotably supported on the case main body 48 via a seventh support shaft 85 parallel to the sixth support shaft 79, the first locking lever 84 having on its outer periphery a latching recess 82 with which the engagement projection 80 can be engaged, and a second locking lever 86 pivoting with the first locking lever 84 is also pivotably supported on the case main body 48 via the seventh support shaft 85.

Provided on the second locking lever 86 are a first pin 87 that is inserted through an elongated hole 89 provided in the open link 54 so as to extend vertically, and a second pin 88 that is inserted through a rectangular opening 90 provided in the first cancel lever 56. A torsion spring 91 is provided between the case main body 48 and the first cancel lever 56, the torsion spring 91 urging the first cancel lever 56 in a direction in which the side edge, on the side opposite to the second case 47, of the opening 90 abuts against the second pin 88.

When attaining an unlocked state in which latch release of the rear side door DB is enabled, the electric motor for lock/unlock switching 23 stops after pivoting the worm wheel 78 having the engagement projection 80 engaged with the latching recess 82 to the position shown in FIG. 8, and in this state the second locking lever 86 has pivoted around the axis of the seventh support shaft 85 to the maximum in a counterclockwise direction in FIG. 8. The open link 54 and the first cancel lever 56 thereby attain an attitude in which they extend vertically as shown in FIG. 8, the abutment face 63 on the upper end part of the first cancel lever 56 can abut against the link pin 62 from below and push it up, and the pressing portion 54*a* of the open link 54 also can abut against the ratchet lever 58 from below.

Figure 9:
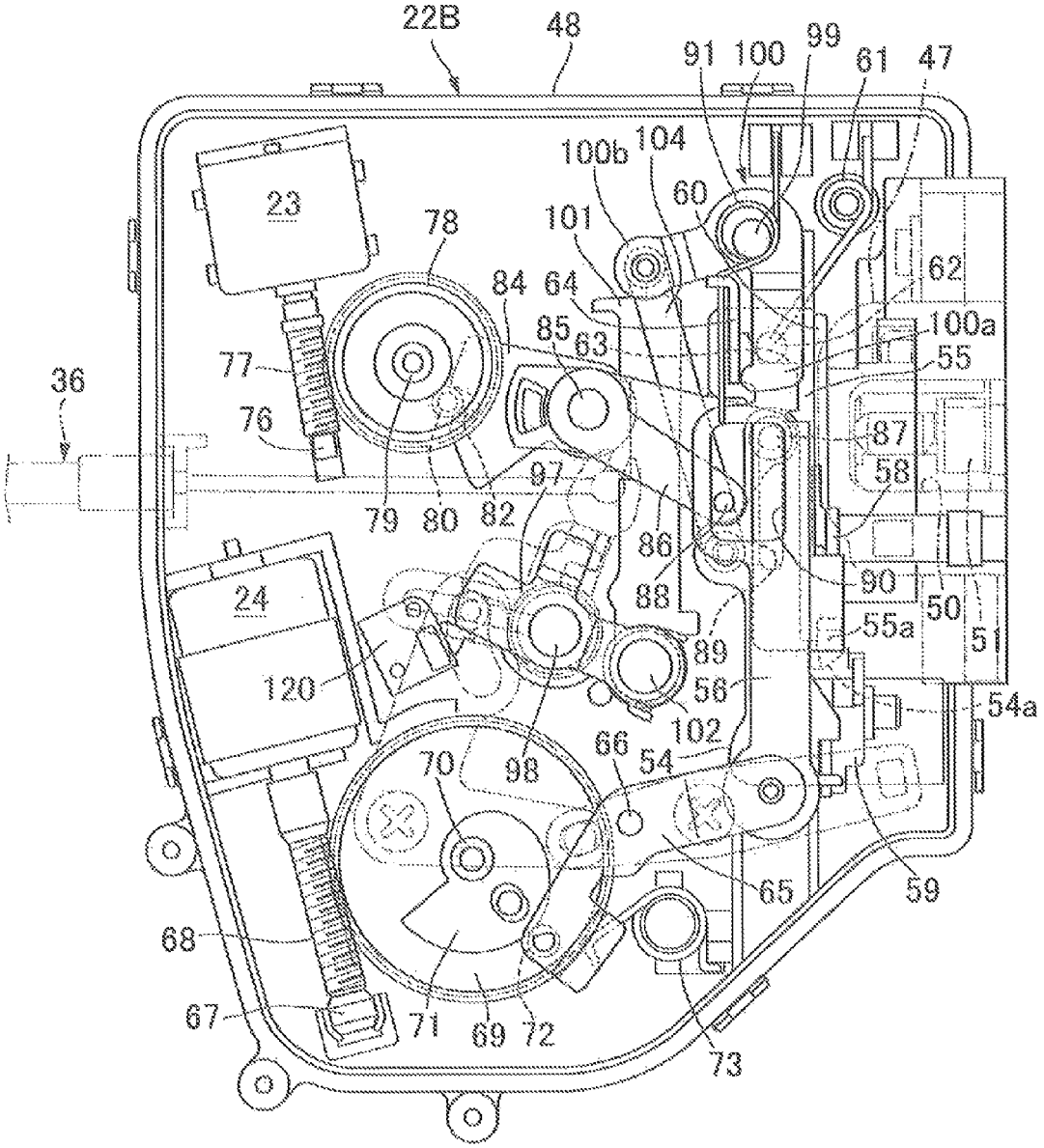
FIG. 9 is a side view, corresponding to FIG. 8, in a latch released state due to actuation of an electric motor for latch release (first embodiment).

When in such an unlocked state the first cancel lever 56 is pushed upwardly as shown in FIG. 9 by actuation of the electric motor for latch release 24, the abutment face 63 on the upper end part of the first cancel lever 56 abuts against the link pin 62 of the release link 55 from below, the release link 55 is pushed upwardly in response to the first cancel lever 56 being further pushed up, the pressing portion 55*a* of the release link 55 abuts against the ratchet lever 58 from below to thus pivot the ratchet lever 58, and the latched state of the rear side door DB is released. Furthermore when, in the unlocked state, the outside handle disposed on the outer side of the rear side door DB is operated so as to pivot the open lever 59, the open link 54 is pushed upwardly, the pressing portion 54*a* of the open link 54 pivots the ratchet lever 58, and this also releases the latched state of the rear side door DB.

Figure 10:
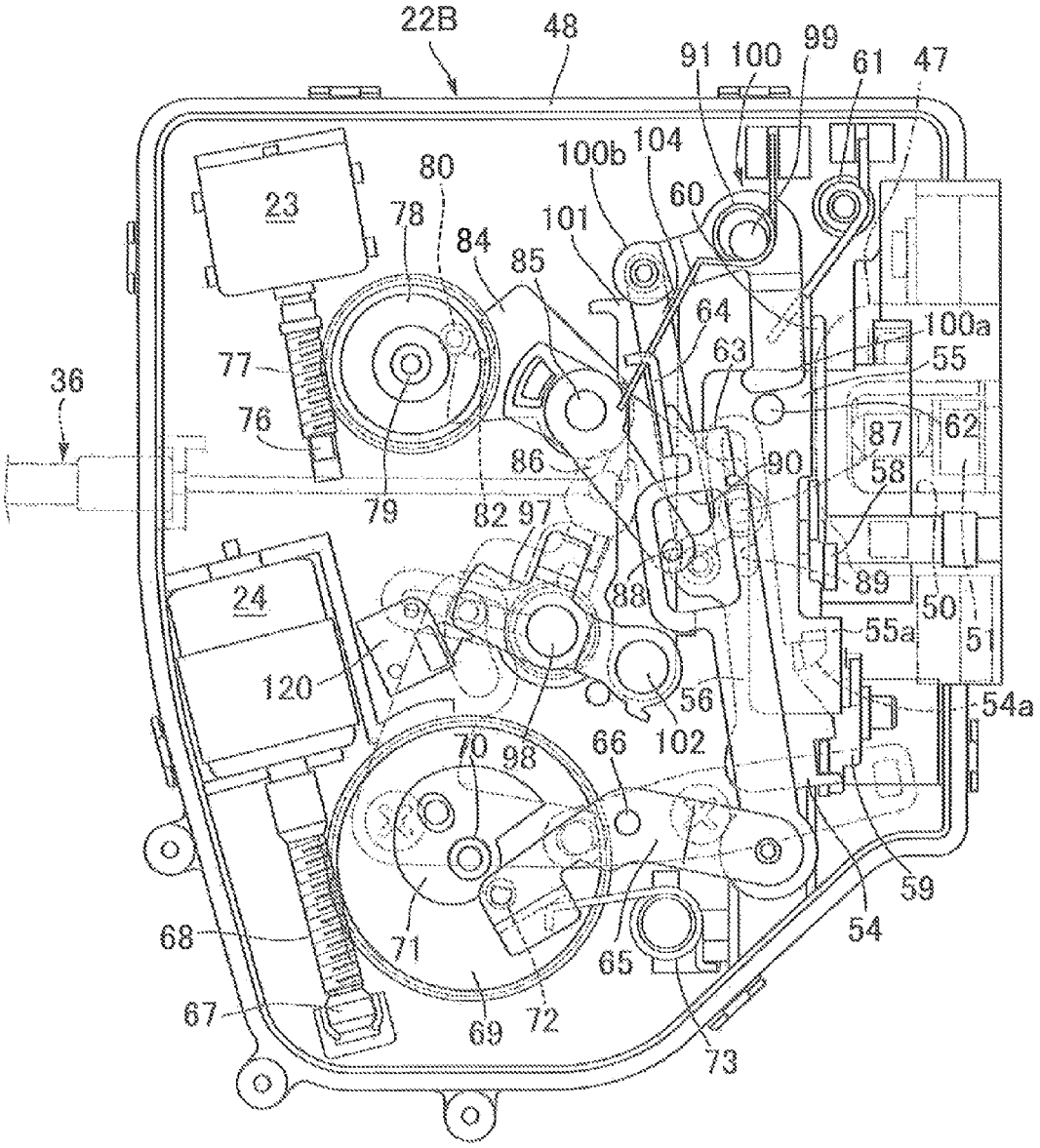
FIG. 10 is a side view, corresponding to FIG. 8, in a locked state (first embodiment).

When attaining the locked state, in which latch release of the rear side door DB by actuation of the electric motor for latch release 24 or operation of the outside handle is disabled, the electric motor for lock/unlock switching 23 pivots the worm wheel 78 in a counterclockwise direction from the state of FIG. 8, and stops after pivoting the worm wheel 78 having the engagement projection 80 engaged with the latching recess 82 to the position shown in FIG. 10, and in this state the second locking lever 86 has pivoted around the axis of the seventh support shaft 85 to the maximum in a clockwise direction in FIG. 10. The open link 54 and the first cancel lever 56 thereby attain an attitude in which they are inclined in a direction that moves away from the guide wall 60 from the vertically extending attitude. In this state, the abutment face 63 on the upper end part of the first cancel lever 56 does not abut against the link pin 62 from below even if the first cancel lever 56 moves upwardly, and the pressing portion 54*a* of the open link 54 is at a position in which it also cannot abut against the ratchet lever 58 from below. Therefore, even if the first cancel lever 56 is pushed upwardly by actuation of the electric motor for latch release 24, the release link 55 does not move upwardly, and even if the open link 54 is moved upwardly by operating the outside handle, the pressing portion 54*a* does not abut against the ratchet lever 58 from below, thereby leaving the rear side door DB in the latched state.

In FIG. 7, the cable 36 for transmitting a mechanical force to the latch mechanism 22B side in response to operation of the push button 29 disposed on the inside handle 21B of the rear side door DB is formed by inserting an inner cable 93 into an outer cable 92, and an end part, on the latch mechanism 22B side, of the outer cable 92 is supported on the case main body 48 of the first case 46.

Figure 11:
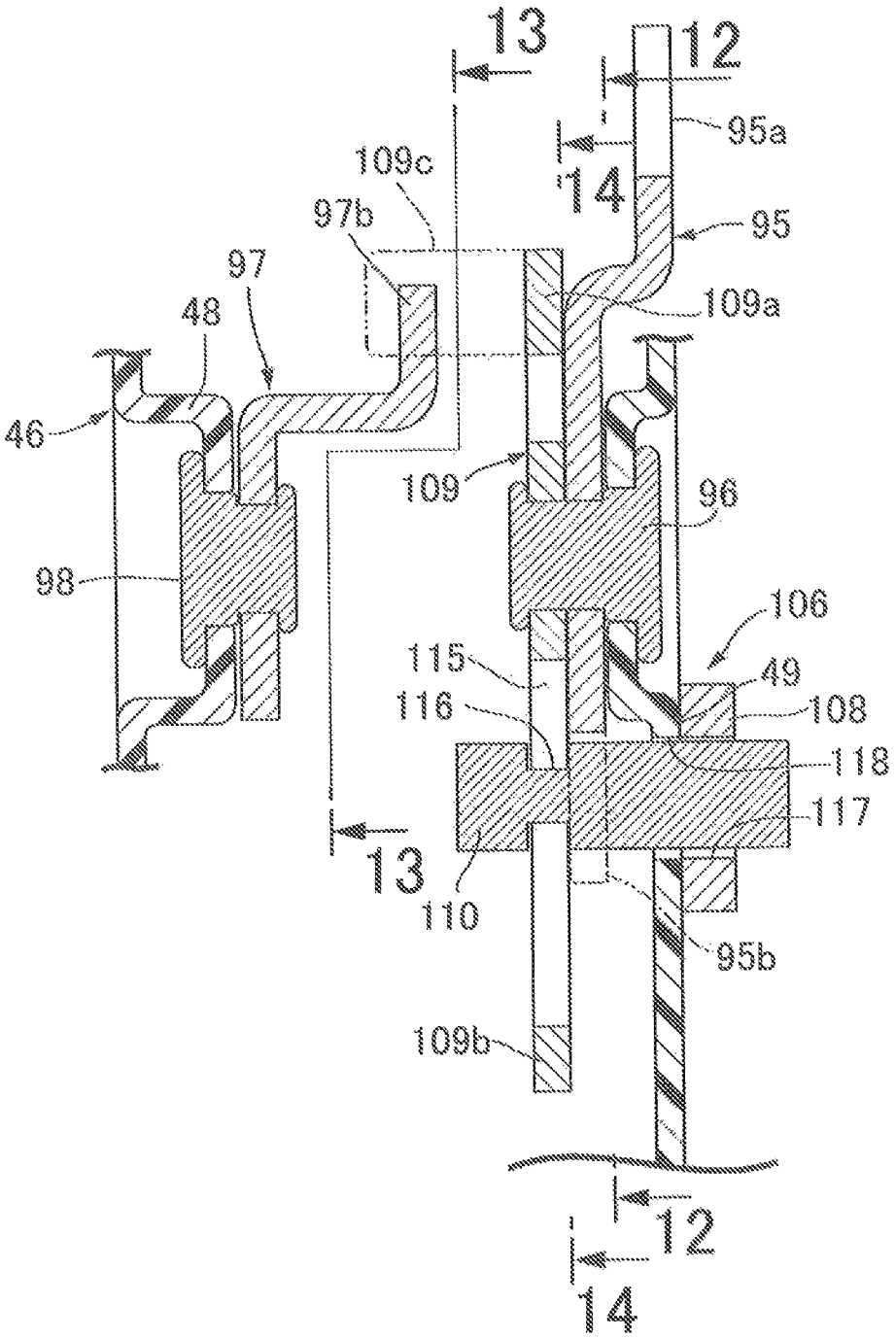
FIG. 11 is a sectional view along line 11-11 in FIG. 7 (first embodiment).
Figure 12:
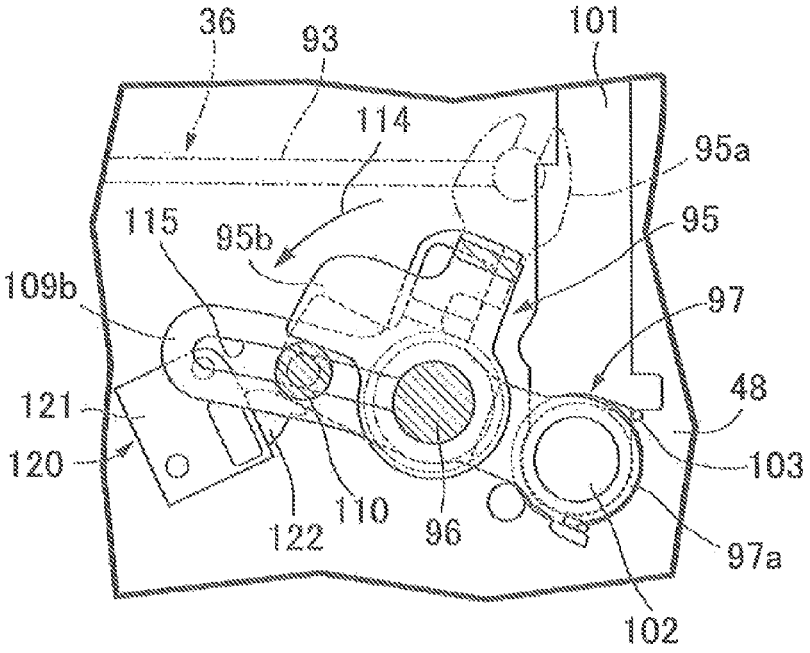
FIG. 12 is a sectional view along line 12-12 in FIG. 11 (first embodiment).

Referring in addition to FIG. 11 and FIG. 12, a mechanical operating force input lever 95 is pivotably supported on the cover member 49 of the first case 46 via an eighth support shaft 96, a mechanical latch release operating force from the push button 29 of the inside handle 21B being transmitted to the mechanical operating force input lever 95.

The mechanical operating force input lever 95 integrally has a link arm portion 95*a* and a pressing arm portion 95*b* provided so as to be connected to the link arm portion 95*a* at right angles, an end part of the inner cable 93 projecting from the outer cable 92 being linked to the extremity of the link arm portion 95*a*. The mechanical operating force input lever 95 is pivotably supported on the cover member 49 via the eighth support shaft 96 so that the majority thereof apart from the extremity of the link arm portion 95*a* is disposed inside the cover member 49.

The extremity of the link arm portion 95*a* projects outwardly from the cover member 49, and the inner cable 93 is linked to the extremity of the link arm portion 95*a*. As a result, when the cable 36 is pulled in response to operation of the push button 29 disposed on the inside handle 21B of the rear side door DB, the mechanical operating force input lever 95 pivots around the axis of the eighth support shaft 96 in a counterclockwise direction in FIG. 12.

Figure 13:
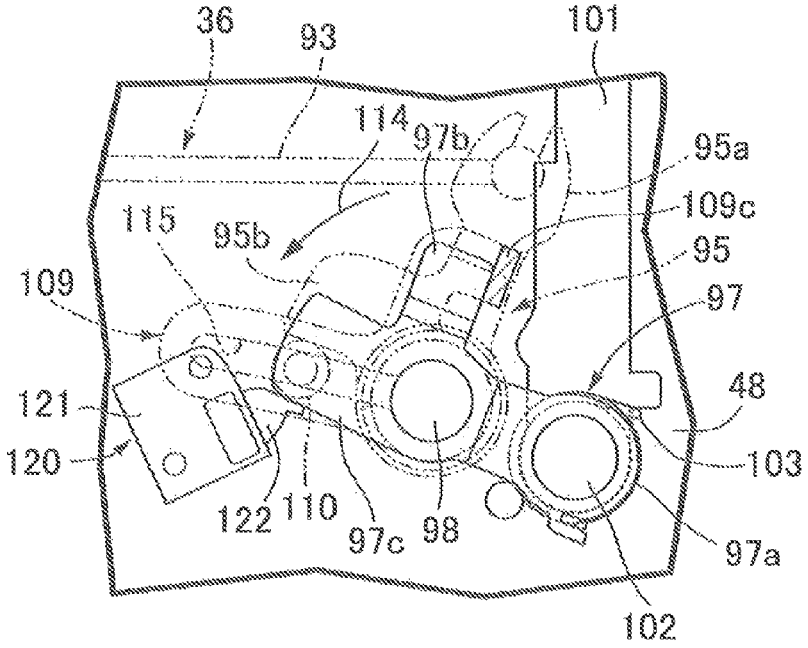
FIG. 13 is a sectional view along line 13-13 in FIG. 11 (first embodiment).

Referring in addition to FIG. 13, an actuating lever for latch release 97, which is an actuating member for latch release, is pivotably supported on the case main body 48 of the first case 46 via a ninth support shaft 98 that is coaxial with the eighth support shaft 96, the actuating lever for latch release 97 being actuated in response to input of a mechanical latch release operating force and releasing the latched state of the rear side door DB in response to the amount of actuation becoming a predetermined amount or greater.

The actuating lever for latch release 97 is formed so as to integrally have a link arm portion 97*a* linked to a lower end part of a vertically extending coupling link 101 via a link pin 102, a pressure-receiving arm portion 97*b* extending in a direction substantially perpendicular to the link arm portion 97*a*, and a detection arm portion 97*c* extending in a direction opposite to the link arm portion 97*a*.

A torsion spring 103 is provided between the link arm portion 97*a* and a lower end part of the coupling link 101, the coupling link 101 is pivotingly urged around the axis of the link pin 102 in a counterclockwise direction in FIG. 8 to FIG. 10, and the end of pivoting of the coupling link 101 in the direction in which it is pivotingly urged by the torsion spring 103 is restricted by abutment against the first locking lever 84. Furthermore, the first locking lever 84 is operatively linked to an intermediate part of the coupling link 101 when the coupling link 101 moves upwardly from the lowest position only by a predetermined amount of travel, and when the coupling link 101 moves further upwardly, the first locking lever 84 and the second locking lever 86 are pivoted in a counterclockwise direction in FIG. 8 to FIG. 10.

A second cancel lever 100 is pivotably supported on the case main body 48 above the open link 54, the release link 55, and the first cancel lever 56 via a tenth support shaft 99. This second cancel lever 100 integrally has a pressing arm portion 100*a* opposing the latching plate part 64 of the first cancel lever 56 from the guide wall 60 side, and a link arm portion 100*b* positioned above the coupling link 101, the extremity of the link arm portion 100*b* and a longitudinally intermediate part of the open link 54 being linked via a cancel link 104. When the coupling link 101 is pushed upwardly, the upper end of the coupling link 101 abuts against the extremity of the link arm portion 100*b* of the second cancel lever 100 to thus push up the link arm portion 100*b*, the latching plate part 64 is pressed by the pressing arm portion 100*a*, the first cancel lever 56 attains an inclined attitude, and the open link 54 is pulled upwardly.

Furthermore, a child lock mechanism 106 is disposed on the latch mechanism 22B of the rear side door DB, the child lock mechanism 106 disabling latch release of the latch mechanism 22B even by normal operation or emergency operation of the push button 29 disposed on the inside handle 21B of the rear side door DB.

Referring to FIG. 7 and FIG. 11, the child lock mechanism 106 is formed so as to be switched between linking and unlinking of the actuating lever for latch release 97 and the mechanical operating force input lever member 95 to which a mechanical latch release operating force from the push button 29 is transmitted, the child lock mechanism 106 including a first child lever 107 that is disposed on an outside face of the cover member 49 of the first case 46 while having an operating portion 107*a* in one end part, a second child lever 108 that is disposed on an outside face of the cover member 49 and that has one end part linked to the other end part of the first child lever 107, a relay lever 109 that is pivotably supported on the base member 49 via the eighth support shaft 96 together with the mechanical operating force input lever 95 so as to sandwich the mechanical operating force input lever 95 between itself and the cover member 49, and a pin 110 that has one end part linked to the relay lever 109 so as to be movable along a radial direction of the eighth support shaft 96 and that has its other end part extending through the cover member 49 and passing through the other end part of the second child lever 108.

An intermediate part of the linearly extending first child lever 107 is pivotably supported on the cover member 49 via an eleventh support shaft 111, and the operating portion 107*a* in said one end part thereof is disposed at a position in which it cannot be operated unless the rear side door DB is in an open state. An intermediate part of the second child lever 108, which is bent into a substantially L-shaped form, is pivotably supported on the cover member 49 via a twelfth support shaft 112, and one end part of the second child lever 108 is linked to the other end part of the first child lever 107 via a link pin 113.

Figure 14:
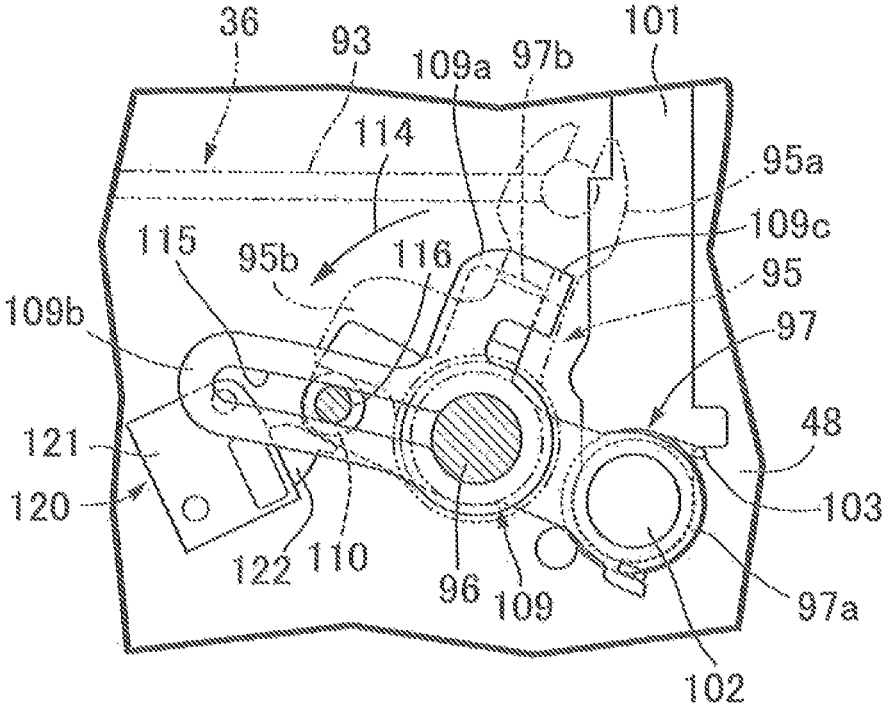
FIG. 14 is a sectional view along line 14-14 in FIG. 11 (first embodiment).

Referring to FIG. 14, the relay lever 109 includes a pressing arm portion 109*a* disposed at a position in which it overlaps the pressure-receiving arm portion 97*b* in the axial direction of the eighth and ninth support shafts 96 and 98 when the actuating lever for latch release 97 is in a non-actuated state, and an arm portion 109*b* extending radially outwardly of the eighth support shaft 96 at a position spaced from the arm portion 109*a* in the peripheral direction of the eighth support shaft 96. A pressing plate portion 109*c* is provided so as to be connected at right angles to the pressing arm portion 109*a*, and the pressing plate portion 109*c* opposes and abuts against the pressure-receiving arm portion 97*b* of the actuating lever for latch release 97 in a non-actuated state from the rear along a pivoting direction 114 of the mechanical operation input lever 95 due to being pulled by the cable 36. Therefore, when the relay lever 109 pivots in a counterclockwise direction in FIG. 14, the actuating lever for latch release 97 also pivots in a counterclockwise direction.

A first elongated hole 115 extending in the radial direction of the eighth support shaft 96 is provided in the arm portion 109*b*, opposite side parts of the first elongated hole 115 are fitted into an annular recess 116 provided on the outer periphery of one end part of the pin 110, and said one end part of the pin 110 is linked to the arm portion 109*b* of the relay lever 109 so as to be movable along the first elongated hole 115. Moreover, the pressing arm portion 95*b* of the mechanical operating force input lever 95 can abut against the pin 110 at an intermediate position in the longitudinal direction of the first elongated hole 115 from the rear along the pivoting direction 114, and the outer end of the first elongated hole 115 is set so as to be positioned further outward than the outer end of the pressing arm portion 95*b* along the radial direction of the eighth support shaft 96.

A second elongated hole 117 is provided in the other end part of the second child lever 108, the second elongated hole 117 being formed into an arc shape with the axis of the eighth support shaft 96 as the center when the second child lever 108 is in the non-operated state, and the other end part of the pin 110 is inserted through the second elongated hole 117. Moreover, when the second child lever 108 is in the non-operated state, the pin 110 is at an intermediate position in the longitudinal direction of the first elongated hole 115, and the pin 110 is at the upper end position of the second elongated hole 117 when the cable 36 is in a non-pulled state.

Furthermore, a guide hole 118 is provided in the cover member 49, the guide hole 118 having a shape that matches the first and second elongated holes 115 and 117 when the second child lever 108 is in a non-operated state, and the pin 110 extending through the guide hole 118.

Figure 15:
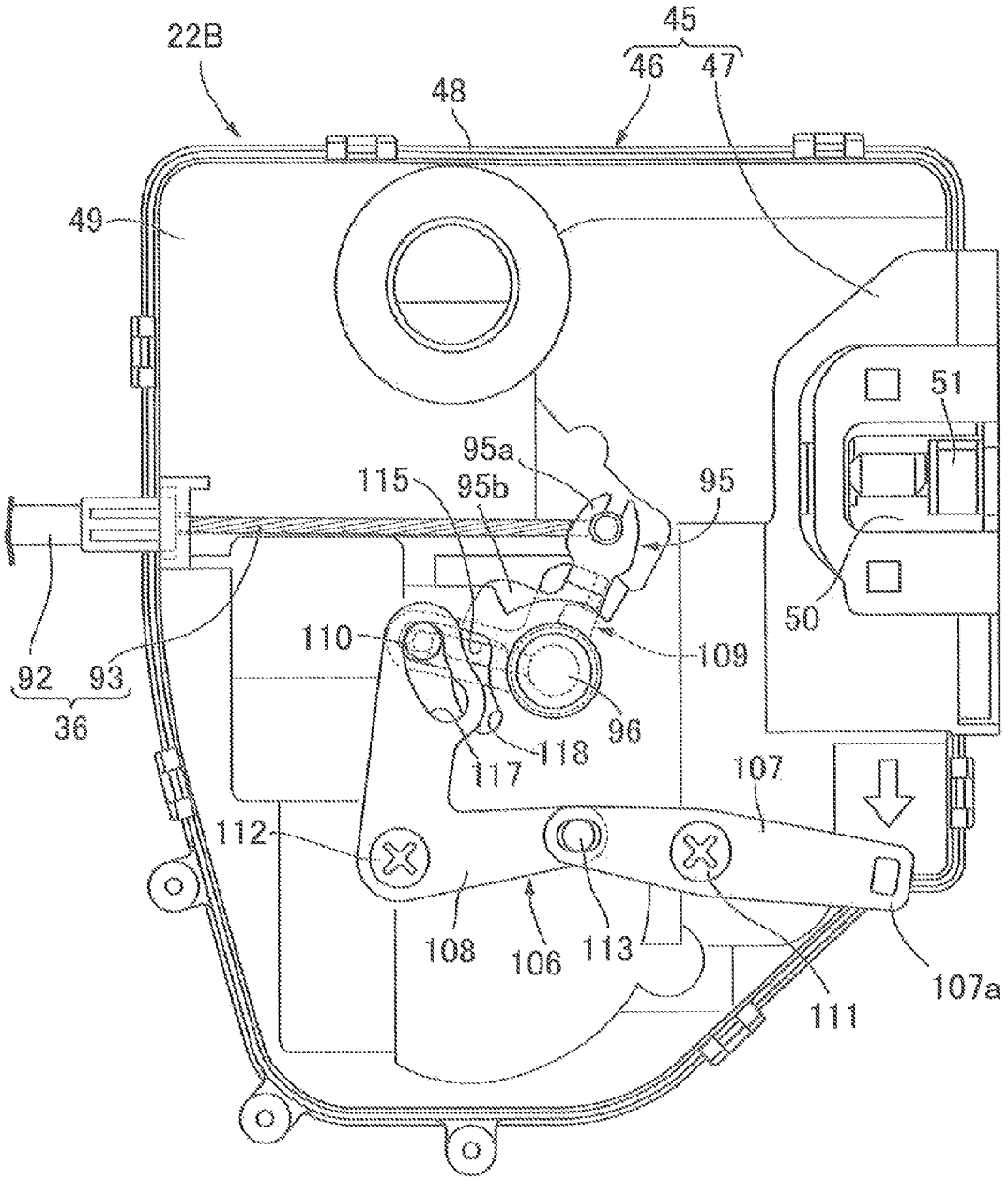
FIG. 15 is a side view, corresponding to FIG. 7, of the latch mechanism in a state in which a child lock mechanism is operated (first embodiment).
Figure 16:
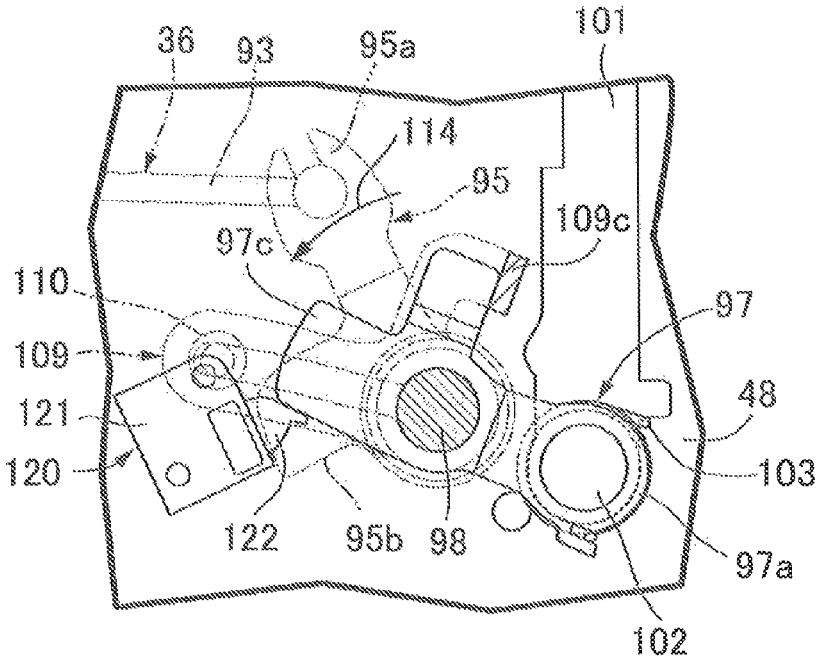
FIG. 16 is a sectional view, corresponding to FIG. 13, in a state in which the child lock mechanism is operated (first embodiment).

When the child lock mechanism 106 is operated, the operating portion 107*a* of the first child lever 107 is pushed down as shown in FIG. 15, and the first child lever 107 is pivoted in a clockwise direction in FIG. 15. By so doing, the second child lever 108 pivots in a counterclockwise direction in FIG. 15, and the pin 110 having one end part inserted through the upper end part of the second elongated hole 117 moves outwardly within the first elongated hole 115 in response to pivoting of the second child lever 107, and moves further outwardly than the pressing arm portion 95*b* of the mechanical operating force input lever 95. Because of this, even if the mechanical operating force input lever 95 pivots in the pivoting direction 114 due to the cable 36 being pulled, the pressing arm portion 95*b* of the mechanical operating force input lever 95 does not abut against the pin 110 as shown in FIG. 16 but instead misses it, and the pivoting force is not transmitted from the mechanical operating force input lever 95 to the relay lever 109 via the pin 110. Because of this, the actuating lever for latch release 97 does not pivot, and the non-actuated state remains.

A switch 120 is disposed on the latch mechanism 22B, the switch 120 being latch release intention detection means that detects that the push button 29 disposed on the inside handle 21B of the rear side door DB has been subjected to normal operation and actuates the electric motor for latch release 24. This switch 120 is mounted on the case main body 48 of the first case 46 of the latch mechanism 22B so as to detect actuation of the actuating lever for latch release 97 to which the mechanical latch release operating force from the push button 29 is transmitted via the mechanical operating force input lever 95, the pin 110, and the relay lever 109.

The switch 120 has a switch case 121 secured to the case main body 48 and a detector 122 projecting from the switch case 121, the detector 122 being resiliently urged in a direction in which it projects from the switch case 121, and is arranged so that its switching mode is changed by the detector 122 being pushed in.

The switch case 121 is secured to the case main body 48 at a position in which the detector 122 is pushed in by the detection arm portion 97*c* of the actuating lever for latch release 97 when the pivoting force from the mechanical operating force input lever 95 is transmitted via the pin 110 and the relay lever 109 and the actuating lever for latch release 97 is thereby pivoted.

Figure 17:
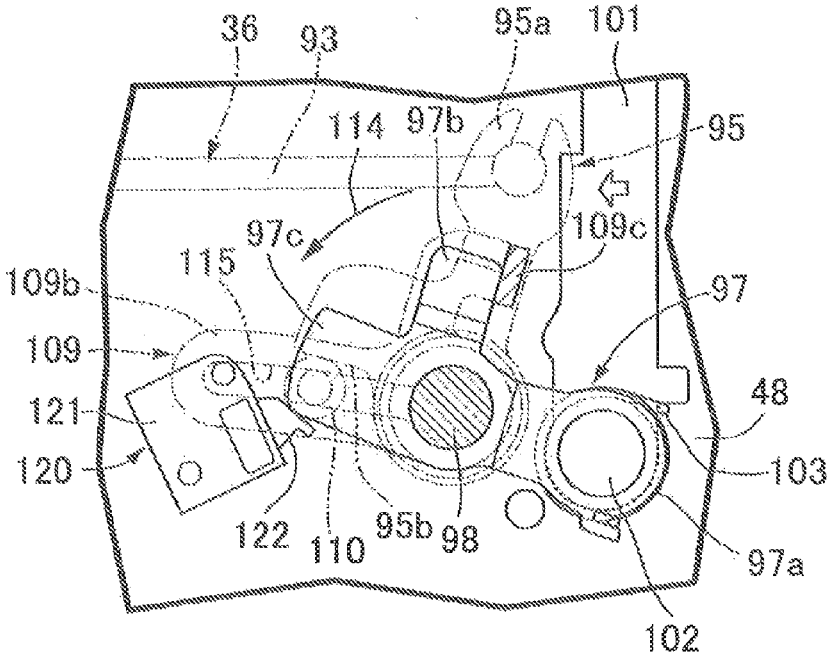
FIG. 17 is a sectional view, corresponding to FIG. 13, at a time of normal operation in a state in which the child lock mechanism is not operated (first embodiment).

When the child lock mechanism 106 is in a non-operated state, the pin 110 is at an intermediate position in the longitudinal direction of the first elongated hole 115, and the pivoting force is transmitted from the mechanical operating force input lever 95 to the actuating lever for latch release 97; if the push button 29 disposed on the inside handle 21B of the rear side door DB is subjected to normal operation, as shown in FIG. 17, the mechanical operating force input lever 95 slightly pivots in response to the cable 36 being slightly pulled, in response thereto the actuating lever for latch release 97 slightly pivots, the detector 122 of the switch 120 is pushed in by the detection arm portion 97*c* of the actuating lever for latch release 97, this changes the switching mode of the switch 120, and the electric motor for latch release 24 is thereby actuated in a direction in which the latched state is released.

Figure 18:
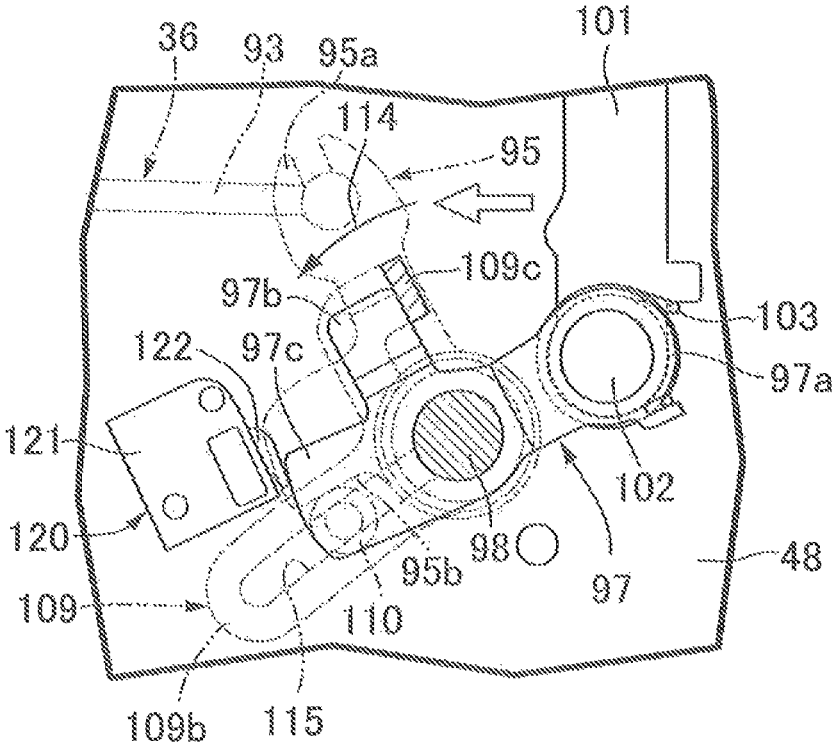
FIG. 18 is a sectional view, corresponding to FIG. 13, at a time of emergency operation in a state in which the child lock mechanism is not operated (first embodiment).

Furthermore, when the child lock mechanism 106 is in a non-operated state, if the push button 29 disposed on the inside handle 21B of the rear side door DB is subjected to an emergency operation, as shown in FIG. 18, the mechanical operating force input lever 95 pivots a large amount in response to the cable 36 being pulled a large amount, in response thereto the actuating lever for latch release 97 pivots a large amount, and the detector 122 of the switch 120 remains pushed by the detection arm portion 97*c* of the actuating lever for latch release 97.

Figure 19:
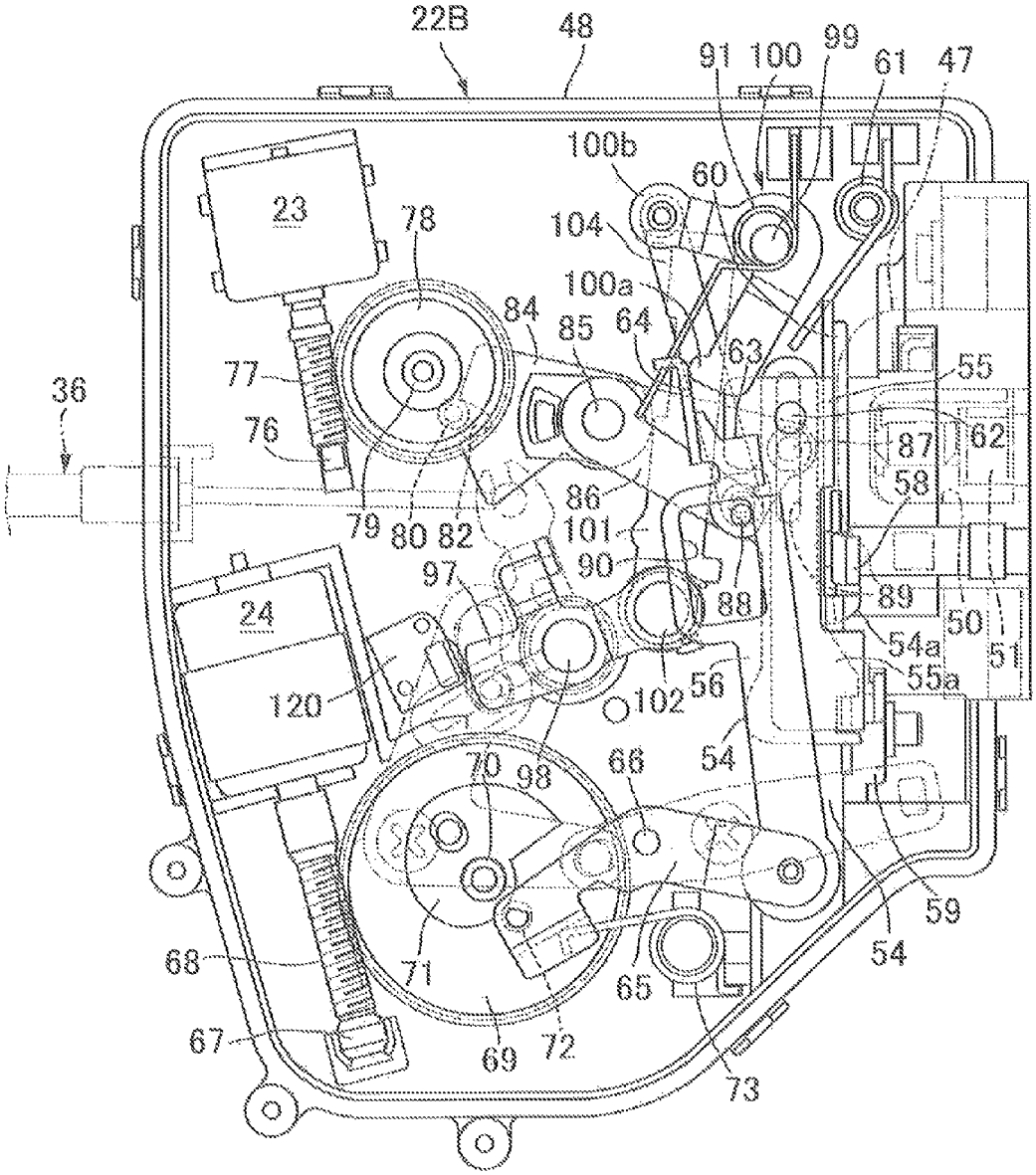
FIG. 19 is a side view, corresponding to FIG. 8, at a time of emergency operation in a state in which the child lock mechanism is not operated (first embodiment).

In this way, when the actuating lever for latch release 97 pivots a large amount, as shown in FIG. 19, the coupling link 101 is pushed upwardly a large amount, the second cancel lever 100 pivots in a clockwise direction in FIG. 19, the first cancel lever 56 attains an attitude in which the abutment face 63 is inclined so as to be displaced sideways from below the link pin 62, and the open link 54 is pulled upwardly. In this process, since the second locking lever 86 pivots in a counterclockwise direction in FIG. 19, and the first pin 87 of the second locking lever 86 is inserted through the elongated hole 89 of the open link 54, the open link 54 attains a vertically extending attitude due to pivoting of the second locking lever 86, the pressing portion 54*a* of this open link 54 abuts against and engages with the ratchet lever 58 from below so as to pivot the ratchet lever 58, and the latched state of the rear side door DB is thereby released.

Referring to FIG. 2, the latch mechanism 22A of the driver's seat-side side door DA is arranged in the same manner as for the latch mechanism 22B of the rear side door DB except that the child lock mechanism 106 is not provided and a mechanism for releasing a latched state in response to a latch release operating force being inputted from a cylinder lock 125 is provided on the driver's seat-side side door DA (see FIG. 1), and a detailed explanation thereof is omitted.

The operation of this embodiment is now explained. The latch mechanisms 22A, 22B, which include the electric motors for latch release 24 that can exert power for latch release, are provided on all doors including the driver's seat-side side door DA and the rear side door DB so as to release a latched state in response to actuation of the electric motors for latch release 24 or input of a mechanical latch release operating force. The push buttons 29, which can be subjected to a normal operation of a vehicle user to actuate the electric motors for latch release 24 and an emergency operation of a vehicle user to input a mechanical latch release operating force into the latch mechanisms 22A, 22B, are disposed on the inside handles 21A, 21B of all doors, including the driver's seat-side side door DA and the rear side door DB. Since each of the inside handles 21A, 21B is provided with the operating member for restriction release 37 that can be operated by a vehicle user and the emergency operation restriction means 38 that restricts emergency operation of the push buttons 29 when the operating member for restriction release 37 is in a non-operated state but that allows emergency operation of the push buttons 29 in response to operation of the operating member for restriction release 37, it is possible to avoid an emergency operation of the push buttons 29 being carried out unnecessarily.

Furthermore, the latch mechanism 22B provided on the rear side door DB includes the actuating lever for latch release 97 that is actuated in response to input of a mechanical latch release operating force, and can release a latched state in response to the actuating lever for latch release 97 being actuated by at least a predetermined amount and can also release a latched state by actuation of the electric motor for latch release 24. The switch 120 for detecting that a vehicle user has carried out normal operation of the push button 29 disposed on the inside handle 21B of the rear side door DB and actuating the electric motor for latch release 24, and the child lock mechanism 106 for disabling latch release even by normal operation and emergency operation of the push button 29 are disposed on the latch mechanism 22B. Since the child lock mechanism 106 is arranged so as to switch between linking and unlinking the actuating lever for latch release 97 and the mechanical operating force input lever 95 to which the mechanical latch release operating force from the push button 29 is transmitted, and the switch 120 detects actuation of the actuating lever for latch release 97, it is unnecessary to employ a structure for restricting operation of the push button 29 when the child lock is in effect, and it is possible to disable latch release due to operation of the push button 29 when the child lock is in effect by means of a simple structure having a smaller number of components while avoiding the internal structure of the inside handle 21B, on which the push button 29 is disposed, becoming complicated and the dimensions of the inside handle 21B increasing.

An embodiment of the present invention is explained above, but the present invention is not limited by the above embodiment and may be modified in a variety of ways as long as the modifications do not depart from the spirit and scope thereof.

The invention claimed is:

1. A latch release device for a vehicle door including a latch mechanism that is selectively movable between latched and unlatched states thereof, the latch release device comprising:

an electric actuator which is operatively connected to the latch mechanism and exerts power for moving the latch mechanism to the unlatched state thereof, a first manually operable operating member that is operatively connected to the latch mechanism and the electric actuator, the first manually operable operating member being configured to activate the electric actuator for moving the latching mechanism to the unlatched state thereof and also configured to assume an emergency unlatching position thereof that applies a mechanical operating force to the latch mechanism for moving the latching mechanism to the unlatched state thereof, a second manually operable operating member operatively associated with the first manually operable operating member, and an emergency operation restrictor that restricts the first manually operable operating member from assuming the emergency unlatching position thereof when the second manually operable operating member is in a non-operated position thereof, but allows the first manually operable operating member to be moved to the emergency unlatching position thereof when the second manually operable operating member is in an operated position thereof.

2. The latch release device for a vehicle door according to claim 1, wherein the second manually operable operating member is configured to be pressed by a vehicle user for being moved to the operated position thereof.

3. The latch release device for a vehicle door according to claim 1, wherein the first and second manually operable operating members are configured to be disposed on opposite sides of an inside handle of the vehicle door.

4. The latch release device for a vehicle door according to claim 1, wherein the first and second manually operable operating members are configured to be disposed on opposite sides of a grip portion of an inside handle of the vehicle door.

5. The latch release device for a vehicle door according to claim 1, further comprising a linkage member pivotally connected between the first and second manually operable operating members, wherein the emergency operation restrictor includes a projecting portion provided with the second manually operable operating member and which engages with the linkage member when the second manually operable operating member is in the non-operated position thereof.

* * * * *